US006880809B2

(12) United States Patent
Stephen et al.

(10) Patent No.: US 6,880,809 B2
(45) Date of Patent: Apr. 19, 2005

(54) SEPARATING DEVICE

(75) Inventors: Robert Stephen, Aberdeenshire (GB); David Wilkie, Aberdeenshire (GB)

(73) Assignee: Future Alignments Limited, Ellon (GB)

( * ) Notice: Subject to any disclaimer, the term of this patent is extended or adjusted under 35 U.S.C. 154(b) by 88 days.

(21) Appl. No.: 10/220,648

(22) PCT Filed: Mar. 5, 2001

(86) PCT No.: PCT/GB01/00915

§ 371 (c)(1),
(2), (4) Date: Feb. 7, 2003

(87) PCT Pub. No.: WO01/66191

PCT Pub. Date: Sep. 13, 2001

(65) Prior Publication Data

US 2003/0151035 A1 Aug. 14, 2003

(30) Foreign Application Priority Data

Mar. 3, 2000 (GB) ..... 0005121

(51) Int. Cl.[7] ..... B66F 1/00
(52) U.S. Cl. ..... 254/105; 269/905

(58) Field of Search ..... 254/104, 106, 254/88; 269/905

(56) References Cited

U.S. PATENT DOCUMENTS

| | | | | |
|---|---|---|---|---|
| 3,819,153 A | * | 6/1974 | Hurst et al. | 254/93 R |
| 4,299,347 A | | 11/1981 | Rougier | |
| 4,712,771 A | * | 12/1987 | Donnelly et al. | 254/131 |
| 5,374,033 A | * | 12/1994 | Tilman | 254/104 |
| 6,267,354 B1 | * | 7/2001 | Stephen | 254/93 R |

FOREIGN PATENT DOCUMENTS

| | | |
|---|---|---|
| EP | 0 302 388 A | 2/1989 |
| GB | 2 172 227 A | 9/1986 |
| WO | WO 9847809 A | 10/1998 |

* cited by examiner

*Primary Examiner*—Lee D. Wilson
(74) *Attorney, Agent, or Firm*—Drinker Biddle & Reath LLP

(57) ABSTRACT

A separating device that includes a wedge that extends between first and second plates, with at least one of the plates being supported by a support device such as a bar. The support device supports the or each plate while the device is in use so that the plate(s) are substantially prevented from bending or twisting due to the forces applied to the plate(s).

21 Claims, 5 Drawing Sheets

SEPARATING DEVICE

FIELD OF THE INVENTION

The invention relates to a separating device.

BACKGROUND OF THE INVENTION

Hydraulic lifting and separating wedges are known. These wedges usually consist of a central wedge-shaped portion located between two external plates. The external plates are located between the objects to be separated or under the object to be lifted, and the wedge is driven forward between the two plates in order to push the plates apart, thereby separating the objects or lifting the object.

It is known to couple the plates by a pin and slot arrangement so that the or each plate moves in only one direction. A disadvantage with this is that the load of the objects being separated is concentrated at a critical point and so the plates tend to bend and the mechanism may subsequently jam.

SUMMARY OF THE INVENTION

According to the present invention there is provided a separating device having a wedge member movable between first and second plates to separate the plates, and a support device to support at least one plate when the wedge member is moved.

The support device is typically attached to or moves with the wedge member, and typically supports at least the first plate. It can typically move relative to the first plate to maintain the same support under the first plate along its length as the first plate is moved by the wedge.

The second plate is typically a base, but this is not essential. The device typically includes a body that supports the first plate, and optionally the support device. The body typically includes a slot or groove in which the support device can be located.

One of the first and second plates can typically remain stationary relative to the body. Alternatively, each plate can be arranged to move relative to the body. In a preferred embodiment, the second plate remains stationary relative to the body, and the first plate moves relative to the body and the second plate.

The support device is typically a bar or the like that extends away from an apex of the wedge member, preferably beyond the first plate, and usefully supports the first plate along its length while the wedge member is moving.

The support device typically extends parallel to a sloping face of the wedge member. A face of the support device is preferably co-planar with the sloping face of the wedge member. A longitudinal centre line of the face of the support device is typically collinear with a longitudinal centre line of the sloping face of the wedge member. The support device typically extends away from the wedge member, past the first plate. The support device optionally has a square or circular cross-section. Other cross-sections (e.g. triangular, rectangular etc) may also be used.

At least one of the plates can preferably slide relative to the wedge member. The support device can typically slide relative to at least one of the plates, typically the first plate.

At least one of the plates is preferably constrained to move only in a direction substantially perpendicular to the direction of movement of the wedge member, for example by a first pin and slot arrangement. The first plate is typically constrained by the first pin and slot arrangement.

The first pin and slot arrangement typically comprises a pin in the body that engages a corresponding slot in one of the plates. The pin is typically located in the body and the slot is located in the sidewalls of the upper plate, but the arrangement could be reversed. The first pin and slot arrangement typically resists movement of the or each plate towards and/or away from the apex of the wedge member, but permits movement perpendicular to this.

Typically, at least one plate includes a stepped outer surface, the steps preferably originating at a leading edge of the device. The first plate is typically provided with the stepped outer surface.

The leading edge of the device typically includes interfitting formations provided e.g. at leading edges of the plates where they converge. The interfitting formations typically comprise castellations provided on the leading edge of each plate. The castellations typically interfit when the first and second plates are brought together. The feature of the interfitting formations on the leading edges of the plates has the advantage that the thickness of the leading edge of the device can be reduced whilst its strength is maintained or increased by reinforced portions that interfit between each other when the plates are in the closed position. This allows for an increase in the force that the device is capable of exerting. It will be appreciated that if the maximum force is not required for a particular application, then the thickness of the leading edge of the device may be reduced further. Typically, the interfitting feature allows the thickness of the leading edge to be reduced from 15 mm to 6 mm whilst retaining the same capacity for expansive force.

Preferably, at least one of the plates extends across the sloping face of the wedge member and has sidewalls that extend down each side of the wedge member. Typically, at least one of the plates (via the sidewalls) is slidably coupled to the wedge member by a second pin and slot arrangement.

The second pin and slot arrangement is typically provided between an inner face of at least one plate (typically the first plate) and the wedge member. Preferably, one or more pins are provided on each inner face of the sidewalls of the plate(s) each of which engage one or more slots in the wedge member. Alternatively, the slot(s) may be on the plate(s) and the pin(s) may be on the wedge member. Preferably, the slot(s) in the wedge member extend parallel to the sloping face of the wedge member. The interengagement of the second pin(s) with the second slot(s) typically promotes retraction of the plates to the closed position as the wedge member is retracted.

The device preferably includes a third pin and slot arrangement. The third pin and slot arrangement typically comprises one or more pins that locate into an aperture in the support device. The pin(s) typically pass through a slot in the first plate. The third pin and slot arrangement provides the advantage that the first plate can be held securely against the support device and/or the wedge member during operation of the device. This substantially prevents the first plate from tilting towards the leading edge of the device when in use. Also, the third pin and slot arrangement together with the support device substantially prevents the first plate from bending during use, thereby reducing the tendency of a drive mechanism for the wedge to jam. This has the advantage that the wedge member extends and retracts more smoothly and is less prone to failure. It will be appreciated that the pin(s) may be screws or the like.

A drive mechanism for the wedge member is typically provided, and in one example of the invention, may comprise a hydraulic ram. In another example of the invention, the drive mechanism may comprise a threaded bolt that is coupled to the wedge member to provide for rotation of the threaded bolt relative to the wedge member. Hence, rotation of the threaded bolt in a first direction typically causes a linear movement of the wedge member towards its apex, and rotation of the threaded bolt in a second direction (typically opposite to the first direction) typically causes a linear movement of the wedge member away from its apex. The drive mechanism is optionally coupled to the body.

Optionally, the two plates are located on opposite faces of the wedge member (e.g. one on the sloping face and one on a non-sloping face).

BRIEF DESCRIPTION OF THE DRAWINGS

Embodiments of the present invention shall now be described, by way of example only, with reference to the accompanying drawings in which.

DETAILED DESCRIPTION OF THE PREFERRED EMBODIMENTS

Figure 1:
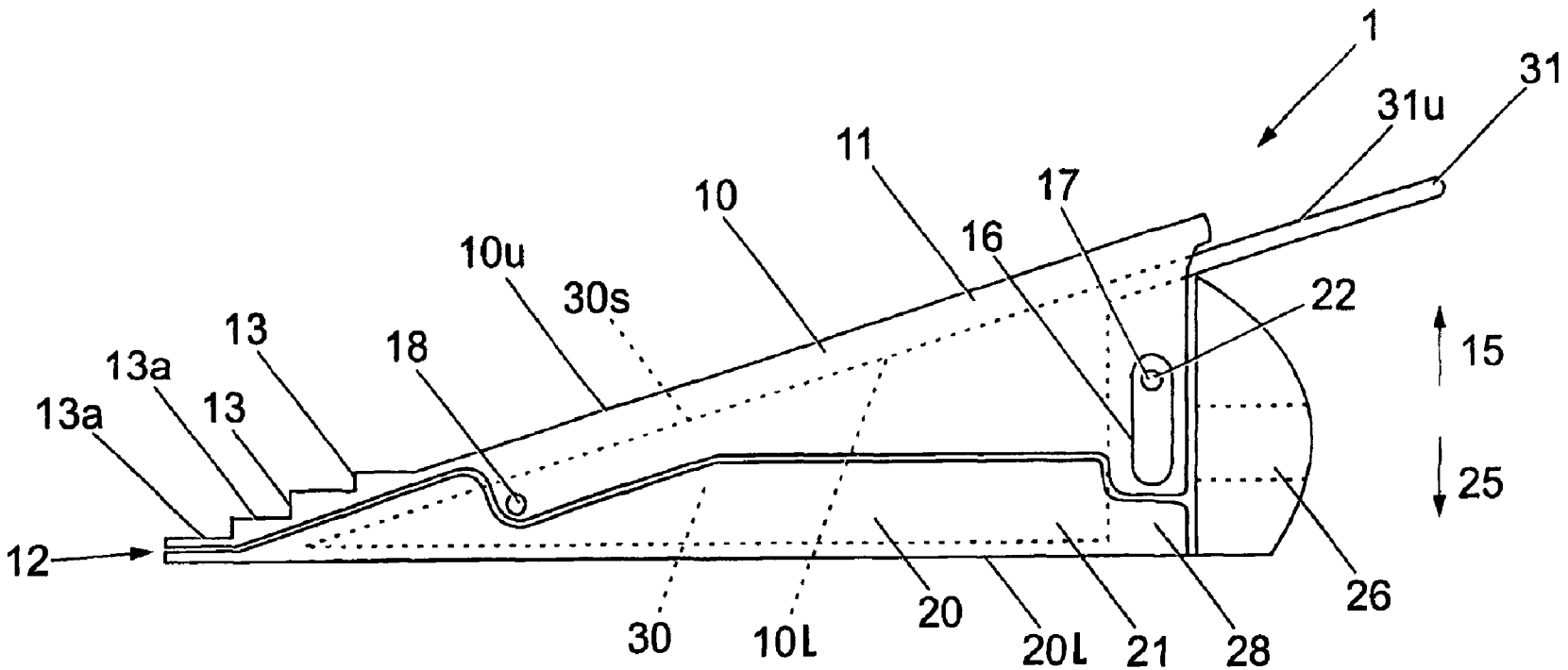
FIG. 1 is a side elevation of an embodiment of a separating device.
Figure 2:
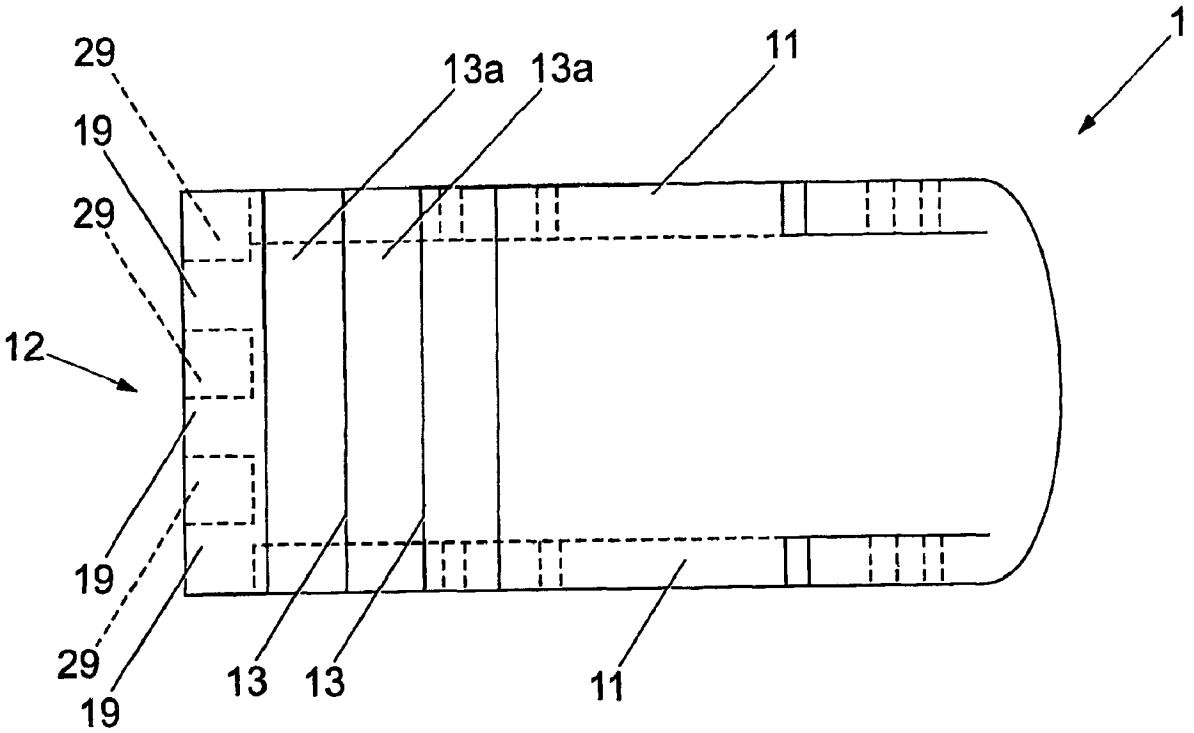
FIG. 2 is a plan view of the FIG. 1 device.
Figure 3:
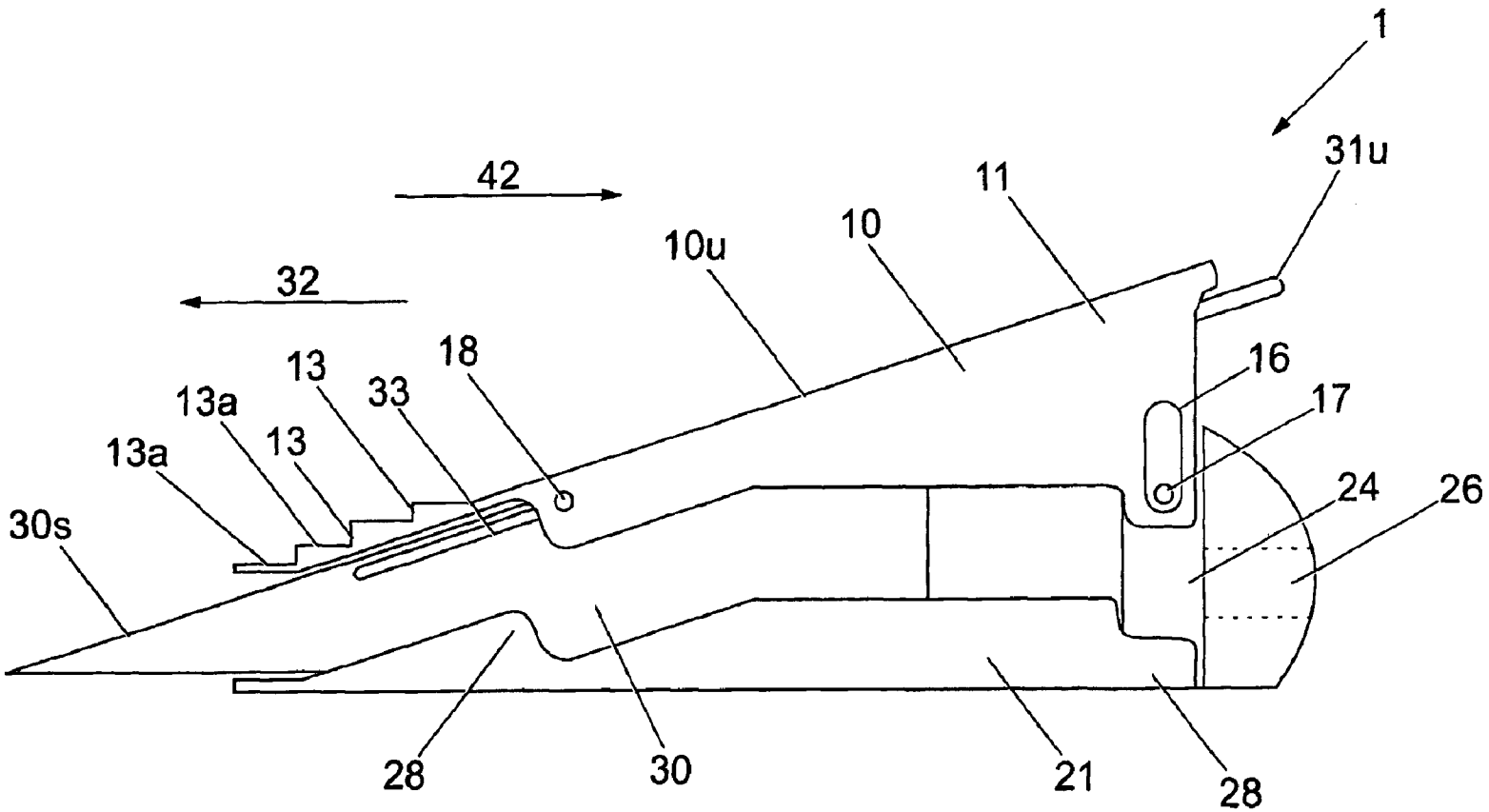
FIG. 3 is a front elevation of the device of FIGS. 1 and 2 in use.

FIG. 1 shows an exemplary embodiment of a separating device 1 that includes a first or upper plate 10, a second or lower plate 20 and a wedge 30. Use of the terms "upper" and "lower" herein refer to the orientation of the device 1 as shown in FIGS. 1 to 3.

The upper plate 10 has two sidewalls 11 that extend downwards in a plane perpendicular to an upper surface 10*u* of the upper plate 10 from opposite edges. The upper plate 10 is normally welded to the sidewalls 11 but may be secured by any conventional means such as counter-sunk bolts or the like, or may be formed as one with the sidewalls 11. Similarly, the lower plate 20 has sidewalls 21 that extend upwards in a plane perpendicular to a lower surface 201 of the lower plate 20 from opposite edges. The edges of sidewalls 11, 21 of the plates 10, 20 can be shaped to interfit with one another to enclose the wedge 30 when the upper plate 10 and the lower plate 20 are brought together (as shown in FIG. 1).

The sidewalls 11 each have a slot 16 that aligns with an aperture 22 provided in a body 24 when the plates 10, 20 are assembled. The body 24 can be formed as a single piece with the lower plate 20. Slot 16 extends in a direction that is substantially perpendicular to the direction of movement of the wedge 30, which is towards and/or away from its apex. A pin 17 extends through the slot 16 and engages in aperture 22 to couple the upper plate 10 to the body 24. The pin and slot arrangement 17, 16 permits linear movement of the upper plate 10 perpendicularly away from the lower plate 20 (i.e. vertically) when the device 1 is orientated as shown in FIG. 1, but substantially prevents movement of the upper plate 10 to the left or right in FIG. 1. Thus, the upper plate 10 is constrained to move in a direction that is substantially perpendicular to the movement of the wedge 30. It will be appreciated that the direction in which the slot 16 extends and the dimensions thereof controls the amount and direction of movement of the upper plate 10.

The body 24 can be used to support the upper plate 10 and includes an aperture 26 (shown in phantom in FIGS. 1 and 3) through which a ram (not shown) of a hydraulic ram mechanism extends so that it may push and pull the wedge 30 towards and/or away from its apex. The aperture 26 may be threaded. Other linear drive mechanisms may be used. For example, a threaded bolt may be threadedly engaged in aperture 26 so that rotation of the bolt (e.g. by a conventional spanner or ratchet) causes movement of the wedge 30 towards and/or away from its apex. The drive mechanism (e.g. the ram) may be coupled to the body 24, but can be separate therefrom.

The aperture 22 is also provided in the body 24, perpendicular to the direction of movement of the wedge 30 and receives the pin 17 connecting the upper plate 10 to the body 24. The body 24 also includes a groove (shown as 160 in FIG. 4) in which a support device 31 can be located.

The wedge 30 is located between the upper plate 10 and the lower plate 20. A connection means (not shown) is provided on the wedge 30 through which it connects with the ram of the hydraulic ram mechanism.

To prevent the upper plate 10 and wedge 30 from deforming due to the load being unevenly distributed on the device 1, the support device in the form of the bar 31 is provided on the wedge 30. When the device is assembled 1 (i.e. when the wedge 30 is located in the lower plate 20, the upper plate 10 is attached, and the pin 17 is located in the slot 16 and aperture 22) the bar 31 extends parallel to a sloping face 30*s* of the wedge 30. In this position, the bar 31 rests in the groove of the body 24 and extends underneath the upper plate 10 and outwards therefrom away from a leading edge 12 of the device 1.

The bar 31 can have a square, circular or w-shaped cross-section, or any other cross-section adapted to resist bending. An upper face 31*u* of the bar 31 preferably slides against a lower face 10*l* of the upper plate 10. The sloping face 30*s* of the wedge 30 also slides against the lower face 10*l* of the upper plate 10. The upper face 31*u* of the bar 31 is typically co-planar with the sloping face 30*s* of the wedge 30 to allow these faces 31*u*, 30*s* to slide along the lower face 10*l* of the upper plate 10.

During manufacture, the bar 31 is normally pre-formed with the wedge 30 but may be formed separately and subsequently welded or otherwise attached (e.g. using counter-sunk bolts or the like) to the wedge 30.

The upper surface 10*u* of the upper plate 10 has a plurality of steps 13 that originate at the leading edge 12 of the device 1. The steps 13 provide a plurality of surfaces that are generally horizontal when the device is orientated as shown in FIG. 1, the exact function being described hereinafter.

Each sidewall 11 is provided with one or more pins 18 on its inner face. The pins 18 are adapted to fit into corresponding slots 33 (FIG. 3) on the wedge 30 so that the sidewalls 11 are slidably coupled to the wedge 30. The slots 33 are parallel to the sloping face 30*s* of the wedge 30 and are provided on each side face of the wedge 30. The or each pin 18 engages in a respective slot 33 so that the pin(s) 18 slide within the slot(s) 33 when the wedge 30 is moved towards and/or away from its apex. As the slot 33 extends parallel to the sloping face 30*s* of the wedge 30, engagement of the pin(s) 18 in the slot(s) 33 helps to promote movement of the upper plate 10 during movement of the wedge 30.

Referring particularly to FIG. 2, a series of castellations 19 are provided on the upper plate 10 at the leading edge 12 of the device 1. This feature allows the width of the leading edge 12 to be reduced. The castellations 19 on the upper plate 10 are designed to fit between castellations 29 provided on the lower plate 20 such that the upper plate 10 and the lower plate 20 can interfit. Interfitting of the castellations 19, 29 allows the width of the leading edge 12 of the device 1 to be reduced, without adversely affecting the strength of it, and the separating force that it can exert. Indeed, the strength of the device 1 can be increased by the reinforced castellations 19, 29 that fit between each other when the plates 10, 20 are brought together.

In use, the leading edge 12 of the device 1 is inserted into a space or gap between two objects (not shown). The steps 13 provide parallel surfaces 13*a* for abutting against the two objects so as to reduce the tendency of the device 1 to slip under load, and allow for the device 1 to be used with various sizes of spaces between the objects, the surfaces 13*a* providing the appropriate contact point. This has the advantage that the spreading or separating force applied to the plates 10, 20 by movement of the wedge 30 is transmitted to the objects to be separated or lifted more efficiently.

The hydraulic ram (or other linear drive mechanism) is activated with the device 1 inserted between the two objects at the appropriate step size. The ram extends towards the leading edge 12 of the device 1, and forces the wedge 30 in the direction of arrow 32, towards the apex of the wedge 30. While the wedge 30 is moving linearly in a direction towards its apex, the upper plate 10 is forced by movement of the wedge 30 in a direction that is substantially perpendicular to the direction of movement of the wedge 30; the first pin and slot arrangement 17, 16 restrains the upper plate 10 from movement in the same direction as the wedge 30, and constrains it to move substantially in the direction of the slot 16 (e.g. perpendicular to movement of the wedge 30).

When the wedge 30 is activated to move in the direction of arrow 32 by the ram, the bar 31 slides along the groove in the body 24 and maintains contact with the upper plate 10 thereby providing support to the portion of the upper plate 10 behind the main part of the wedge 30, and reducing the stresses applied via the plate 10 to the first pin and slot arrangement 17, 16. This substantially prevents the pin 17 and slot 16 from being damaged because the forces are transmitted to the bar 31, rather than directly to the pin and slot arrangement 17, 16.

The upper face 31*u* of the bar 31 is preferably flush with the sloping face 30*s* of the wedge 30, but this is not essential as the upper plate 10 may be provided with a groove or recess into which the bar 31 may extend. Thus, when the wedge 30 is moved in the direction of its apex (and since the upper plate 10 is substantially restrained from moving in the same direction) the wedge 30 forces the upper plate 10 in a direction substantially perpendicular to that of the wedge 30. The sloping face 30*s* of the wedge 30 and the upper face 31*u* of the bar 31 slide down the lower face 10*l* of the upper plate 10.

The hydraulic ram forces the wedge 30 linearly towards its apex until the required gap is formed between the objects or alternatively until the wedge 30 reaches its outer limit. If the wedge 30 reaches its outer limit, the pin 17 reaches the bottom of the slot 16. In any event, the bar 31 is preferably long enough to extend underneath the upper plate 10 and so provide it with support along its entire length. Thus, it is preferred that the bar 31 is sufficiently long so that it extends beyond the extremity of the upper plate 10 when the wedge 30 is moved to its limit in the direction of its apex.

The hydraulic ram and aperture 26 in the body 24 may be threaded to complement one another. Thus rotation of the ram moves the wedge 30 as described above. Alternatively, the aperture 26 may be smooth and the ram merely moves within the aperture 26 to move the wedge 30.

Upon actuation of the hydraulic ram or other linear drive mechanism, the wedge 30 is moved towards its apex and causes the upper plate 10 to move outwardly. The linear movement of the plate 10 separates the objects and the pin 17 and slot 16 prevent the upper plate 10 from twisting or skewing as it moves outwards.

Once the object has been lifted, or the objects separated, the hydraulic ram is then retracted. As a result of the retraction of the ram, the wedge 30 is pulled in a direction away from its apex (i.e. in the direction of arrow 42 in FIG. 3). As the wedge 30 retracts, the interengagement of pin(s) 18 with the slot(s) 33 guides the upper plate 10 towards its initial position, thereby effecting automatic retraction of the upper plate 10. This is advantageous as the upper plate 10 does not require to be manually or otherwise pushed back into the position shown in FIG. 1.

An advantage of the bar 31 is that it supports the whole of the upper plate 10 when the device 1 is in use to ensure an even load distribution over the wedge 30. This prevents the device 1 from warping and therefore reduces the likelihood of the wedge 30 from jamming.

The device 1 may be manufactured from weaker or thinner materials as the bar 31 distributes the load more efficiently and reinforces the upper plate 10. Hence production costs can be reduced.

It will be appreciated that the device 1 can be used in other orientations and need not be used only to lift objects. For example, the lower plate 20 may be rested, placed or held against a substantially vertical surface (rather than horizontal) and used to push an adjacent object away from the surface. Indeed, the device 1 can be used on any surface at any angle.

Figure 4:
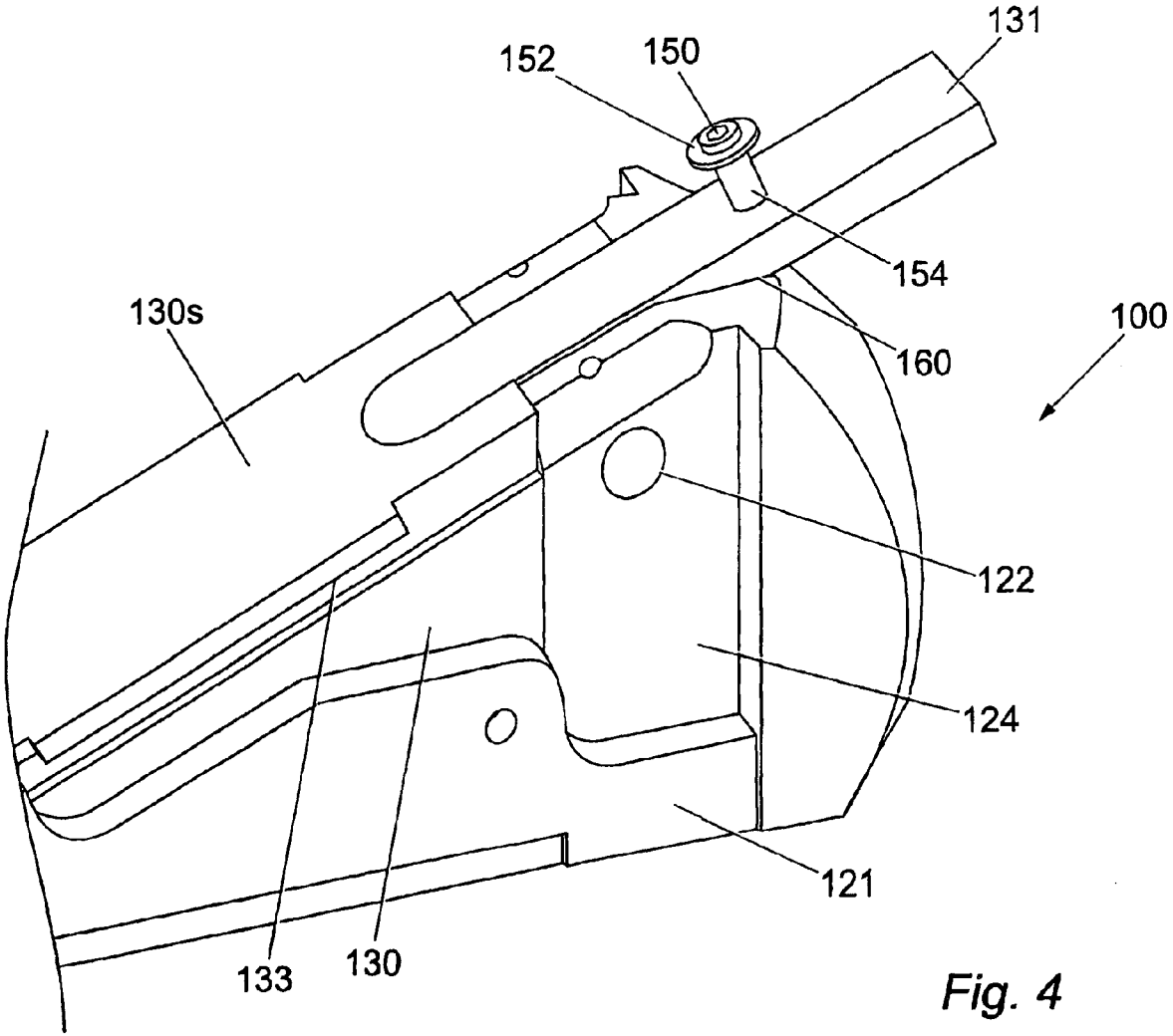
FIG. 4 shows a perspective view of an alternative embodiment of a separating device without an upper plate for clarity.
Figure 5:
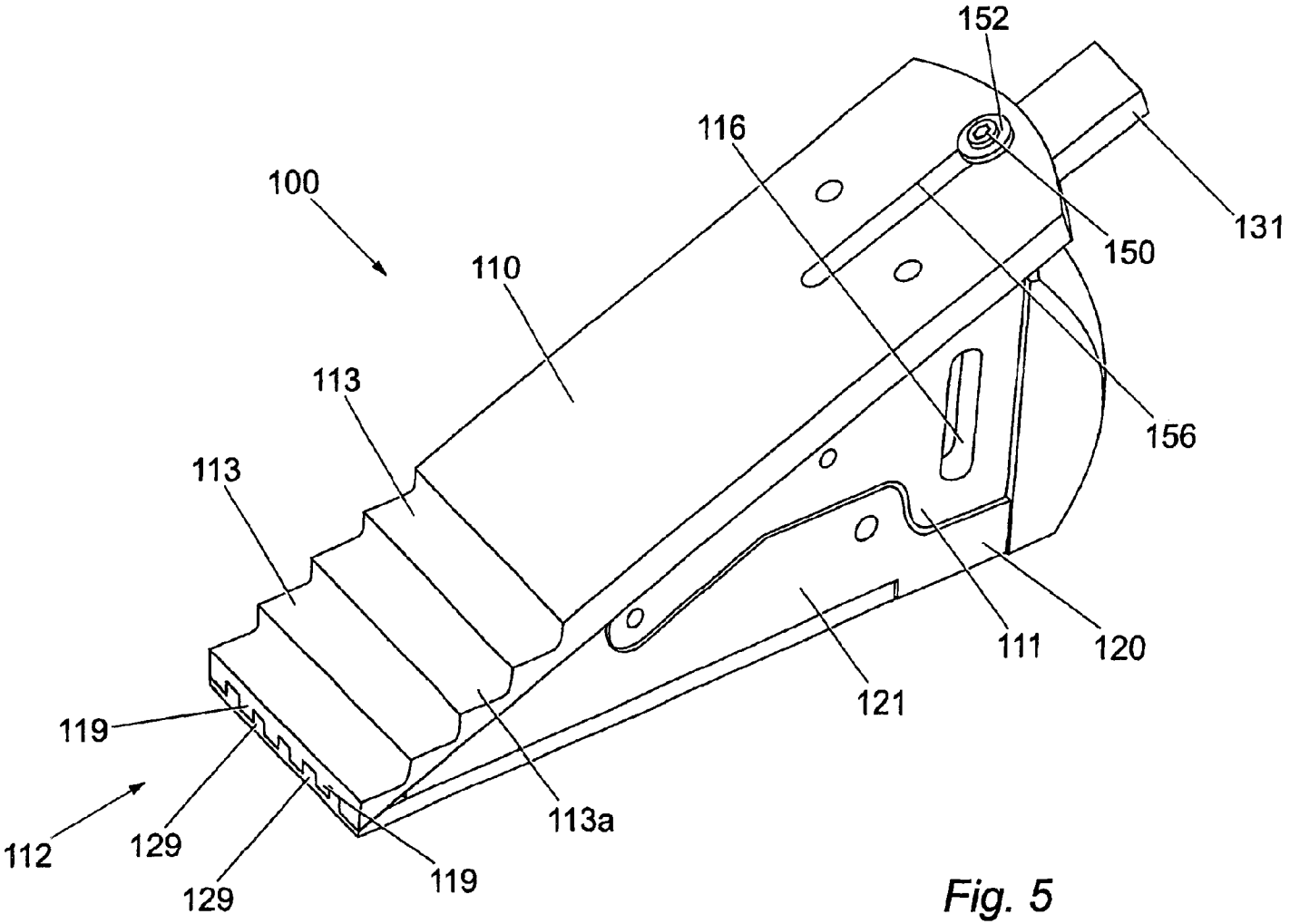
FIG. 5 shows the device of FIG. 4 with the upper plate.

Referring now to FIGS. 4 and 5, there is shown an alternative or modified separating device 100, that is substantially the same as device 1 of FIGS. 1 to 3. The same reference numerals have been used to designate like parts, prefixed "1".

The device 100 is shown in FIG. 4 with the upper plate 110 removed for clarity. The main difference between device 1 and device 100 is the provision of a screw 150 and a washer 152. The screw 150 engages an aperture 154 in the bar 131 and is located through a longitudinal slot 156 in the upper plate 110 (FIG. 5). The screw 150 and slot 156 allow the device 100 to lift at the tip more evenly as the upper plate 110 is held more securely against the wedge 130 (via the bar 131) and thus the upper plate 100 is substantially prevented from tipping towards the leading edge 112 whilst the device 100 is in use.

Also, the screw 150 and slot 156 help to prevent the upper plate 110 from bending due to the forces exerted at the leading edge 112 of the device 100 whilst in use, and thus substantially prevents the movement of the wedge 130 from becoming jammed. This has the advantage that the wedge 130 extends and retracts more smoothly and is less prone to failure due to it becoming stuck.

Modifications and improvements may be incorporated without departing from the scope of the invention.

What is claimed is:

1. A separating device having a wedge member movable between first and second plates to separate the plates, and a support device to support at least one plate when the wedge member is moved, wherein the support device contacts a surface of the first plate and wherein the support device and surface of the first plate can slide relative to one another when the wedge is moved.

2. The separating device according to claim 1, wherein the support device is attached to the wedge member.

3. The separating device according to claim 1, wherein the support device supports the first plate.

4. The separating device according to claim 1, wherein the support device comprises a bar.

5. The separating device according to claim 1, wherein the support device protrudes beyond at least one edge of the first plate.

6. The separating device according to claim 1, wherein the support device supports the first plate along its length while the wedge member is moving.

7. The separating device according to claim 1, wherein the support device extends parallel to a sloping face of the wedge member.

8. The separating device according to claim 7, wherein a face of the support device is co-planar with the sloping face of the wedge member.

9. The separating device according to claim 7, wherein a longitudinal centre line of the face of the support device is collinear with a longitudinal centre line of the sloping face of the wedge member.

10. The separating device according to claim 7, wherein at least one of the plates extends across the sloping face of the wedge member and has sidewalls that extend down each side of the wedge member.

11. The separating device according to claim 1, wherein the device includes a body that supports the first plate and the support device.

12. The separating device according to claim 1, wherein the device includes a body that supports the first plate and wherein the body includes a slot or groove in which the support device can be located.

13. The separating device according to claim 1, wherein the first plate is constrained to move in a direction substantially perpendicular to the direction of movement of the wedge member by a first pin and slot arrangement.

14. The separating device according to claim 1, wherein the device includes a drive mechanism for the wedge member.

15. A separating device according to claim 1, wherein the support device comprises an extension of the wedge member.

16. A separating device as claimed in claim 1, wherein the support device extends away from the apex of the wedge member, past the end of the first plate.

17. A separating device having a wedge member movable between first and second plates to separate the plates, and a support device which contacts the surface of at least one plate and supports said at least one plate when the wedge member is moved, wherein at least one of the plates is slidably coupled to the wedge member by a pin and slot arrangement.

18. The separating device according to claim 1, wherein the second plate remains stationary relative to the body, and the first plate moves relative to the body.

19. A separating device having a wedge member movable between first and second plates to separate the plates, and a support device which contacts the surface of at least one plate and supports said at least one plate when the wedge member is moved, wherein the movement of the at least one plate is guided by a pin and slot arrangement.

20. The separating device according to claim 19, wherein the pin and slot arrangement comprises one or more pins that locate into an aperture in the support device.

21. The separating device according to claim 19, wherein first plate has at least one slot and wherein a pin passes through the at least one slot.

* * * * *